US007318458B2

(12) United States Patent
Moons

(10) Patent No.: US 7,318,458 B2
(45) Date of Patent: Jan. 15, 2008

(54) CLOTH DESIGNED TO BE PROVIDED WITH AT LEAST ONE PERMANENT FOLD AND METHOD APPLIED THEREBY

(75) Inventor: Mark Lodewijk Moons, Reet (BE)

(73) Assignee: Ludvig Svensson B.V., Hellevoetsluis (NL)

( * ) Notice: Subject to any disclaimer, the term of this patent is extended or adjusted under 35 U.S.C. 154(b) by 0 days.

(21) Appl. No.: 10/555,102

(22) PCT Filed: May 7, 2004

(86) PCT No.: PCT/BE2004/000066

§ 371 (c)(1),
(2), (4) Date: Nov. 2, 2005

(87) PCT Pub. No.: WO2004/099478

PCT Pub. Date: Nov. 18, 2004

(65) Prior Publication Data

US 2006/0237086 A1 Oct. 26, 2006

(30) Foreign Application Priority Data

May 8, 2003 (BE) ..... 2003/0278

(51) Int. Cl.
*D03D 13/00* (2006.01)
*D03D 3/08* (2006.01)
*D03D 15/08* (2006.01)
*D03D 1/00* (2006.01)

(52) U.S. Cl. ..... 139/420 R; 139/426 R; 139/420 A

(58) Field of Classification Search ..... 139/420 R, 139/426 R, 420 A; 28/156; 442/203; 156/204, 156/226, 227, 304.7; 428/181
See application file for complete search history.

(56) References Cited

U.S. PATENT DOCUMENTS

| | | | | |
|---|---|---|---|---|
| 2,189,370 | A * | 2/1940 | Shiranezawa | 139/420 R |
| 2,627,644 | A * | 2/1953 | Foster | 428/175 |
| 3,071,165 | A * | 1/1963 | Truslow et al. | 139/426 R |
| 3,476,870 | A | 11/1969 | Ross | |
| 3,491,802 | A * | 1/1970 | Olderman et al. | 139/420 R |
| 3,822,727 | A | 7/1974 | Small et al. | |
| 6,423,165 | B1 * | 7/2002 | Hishinuma | 156/85 |
| 6,725,885 | B2 * | 4/2004 | Mahr | 139/383 R |
| 2005/0229368 | A1 * | 10/2005 | Moons | 28/165 |

FOREIGN PATENT DOCUMENTS

| | | |
|---|---|---|
| DE | 101 00 484 A1 | 7/2002 |
| FR | 334223 | 7/1903 |

(Continued)

OTHER PUBLICATIONS

Patent Abstracts of Japan, vol. 2000, No. 14, Mar. 5, 2001, & JP 2000 310092 A, Nov. 7, 2000.

Patent Abstracts of Japan, vol. 1997, No. 01, Jan. 31, 1997, & JP 08 226045 A, Sep. 3, 1996.

*Primary Examiner*—Gary L. Welch
*Assistant Examiner*—Robert H Muromoto, Jr.
(74) *Attorney, Agent, or Firm*—Bacon & Thomas, PLLC

(57) ABSTRACT

Cloth designed to be provided with at least one permanent fold, wherein at least one shrink thread is woven in said cloth. The shrink thread or shrink threads are woven in the cloth according to a general direction extending crosswise over the fold line.

5 Claims, 3 Drawing Sheets

FOREIGN PATENT DOCUMENTS

| | | |
|---|---|---|
| GB | 851 192 | 10/1960 |
| JP | 55051871 | 4/1980 |
| JP | 002267634 | 7/1988 |
| JP | 08226045 | 9/1996 |
| JP | 09-023967 | 1/1997 |
| JP | 09228209 | 9/1997 |
| NL | 1015812 | 1/2002 |
| WO | 03/087449 | 10/2003 |

* cited by examiner

CLOTH DESIGNED TO BE PROVIDED WITH AT LEAST ONE PERMANENT FOLD AND METHOD APPLIED THEREBY

BACKGROUND OF THE INVENTION

A. Field

The present invention concerns a cloth.

B. Related Art

In particular, the invention concerns a cloth to be provided with at least one permanent fold.

In some cases it is desirable or necessary that a cloth has one or several folds. Thus, in some cases, a zigzag folded cloth is required.

From BE 2002/0267 is known a cloth designed to be provided with at least one permanent fold, whereby a cloth consisting of weft threads bound by warp threads was taken as a basis, whereby in the folding zones, where a fold is to be formed, a folding thread is woven in the direction of the warp threads by means of a shrink thread, making use of the technique of the staggering warp threads.

Although the folds that are formed in this cloth are of a good quality, the method for weaving in the folding threads is time-consuming and difficult, which results in a relatively high production cost.

Moreover, it is found in practice that faults occurring during the weaving in of such a shrink thread according to the technique of the staggering warp threads are difficult to detect and, as a consequence, are usually not corrected.

The invention aims a cloth which provides a solution to the above-mentioned and other disadvantages.

BRIEF SUMMARY OF THE INVENTION

To this end, the invention concerns a cloth designed to be provided with at least one permanent fold, whereby at least one shrink thread is woven in said cloth and whereby the shrink thread or shrink threads are woven in the cloth according to a general direction extending crosswise over the folding zone.

Preferably, at the height of the folding zone, the shrink threads will be situated over a larger distance on a single side of the cloth than outside said folding zone.

An advantage of the cloth according to the invention is that the shrink threads can be woven in a simple and fast manner, such that the production speed can be driven up and the production cost can be lowered.

Another advantage of this cloth is that the shrink threads which have been woven in incorrectly can be easily detected before forming the folds, as the shrink threads are provided in a straight line over the folding zone.

The present invention also concerns a method for manufacturing a cloth with at least one permanent fold.

This method is characterised in that the fold, at least there where a fold should be formed, is subjected to a treatment to make the shrink thread or shrink threads shrink at least in said folding zone.

DESCRIPTION OF THE DRAWINGS

In order to better explain the characteristics of the invention, the following preferred embodiments of a cloth and a method according to the invention for manufacturing a cloth with at least one permanent fold are described as an example only without being limitative in any way, with reference to the accompanying drawings, in which.

DETAILED DESCRIPTION OF PREFERRED EMBODIMENTS

Figure 1:
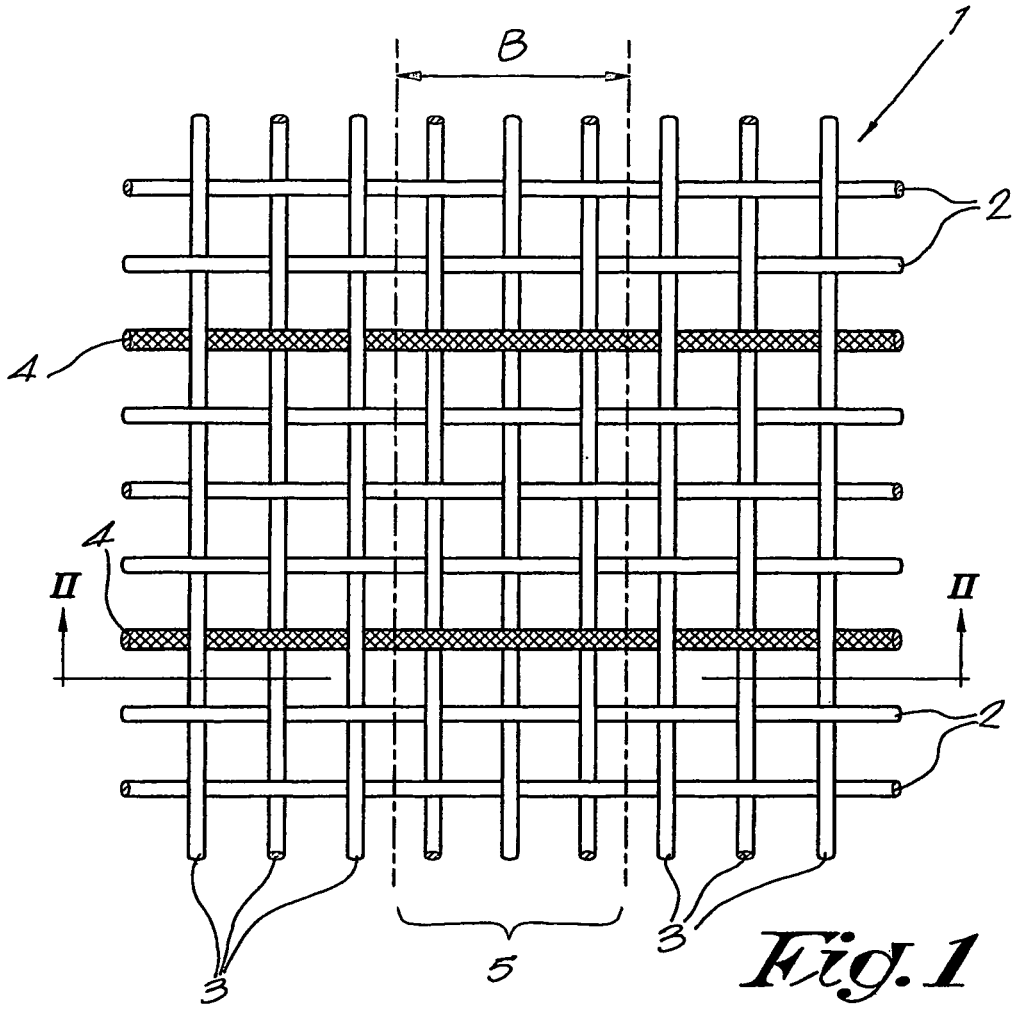
FIG. 1 represents a part of the cloth according to the invention.
Figure 2:
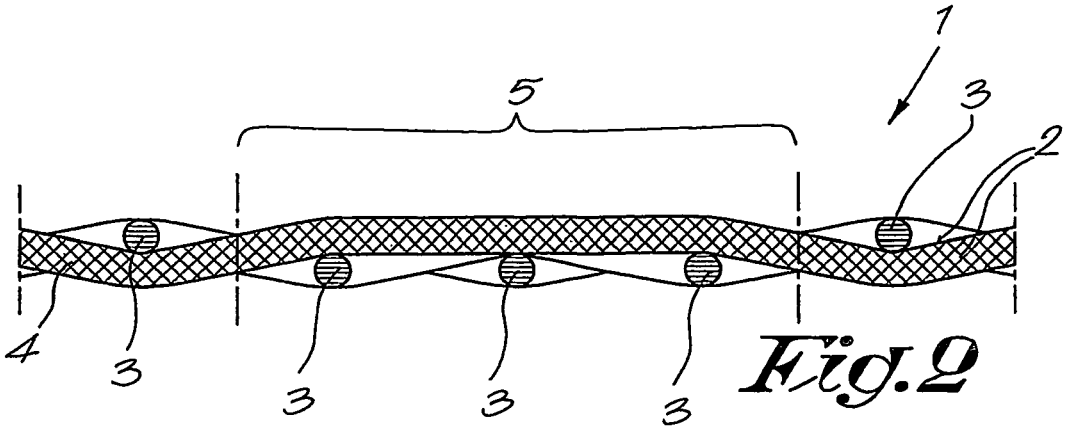
FIG. 2 represents a section according to line II-II in FIG. 1 to a larger scale.

FIGS. 1 and 2 represent a part of a cloth 1 according to the invention, which cloth 1 is in this case woven from weft threads 2 which are bound by warp threads 3 but whereby, at regular distances from each other, in the weft direction, shrink threads 4 are woven in according to a pattern which differs from the pattern elsewhere in the cloth 1 at the height of folding zones 5, which in this case extend in the direction of the warp.

The difference in the weaving pattern consists in that, at the height of the folding zone 5, the shrink threads 4 are situated on a single side of the cloth 1 over a larger distance than anywhere else in the cloth 1, in other words on a single side of the warp threads 3.

In the given example of FIG. 1 the folding zone 5 extends over three warp threads 3 whereby the shrink threads 4 extend on a single side of these three warp threads 3 in the folding zone 5 whereas, outside said folding zone 5, the shrink threads 4 are woven in the same conventional manner as the other weft threads 2, namely alternately above and under the successive warp threads 3.

The term 'thread' has to be interpreted in a broad sense here, which implies that monofilaments as well as yarns or mixtures thereof are to be understood by it.

The yarns can be spun yarns or filament yarns, either or not textured, and even elastic yarns.

The thread may consist of natural material as well as of synthetic material or a combination thereof, and it can possibly be provided with a coating.

The weft threads 2 and the warp threads 3 can be made of different materials.

The shrink threads 4 are made of a material which, under the influence of a thermal, mechanical/thermal, ultrasonic, high-frequency or another appropriate treatment, undergoes a permanent longitudinal shrinkage, preferably of minimum 5%. More precisely, the shrink threads 4 are made of a material that shrinks, on application of an appropriate treatment, with at least 5% more than the material of which are made the remaining threads 2, 3 that are woven in a general direction parallel to said shrink threads 4, whereby this shrinkage may be evaluated in a non-woven condition of the threads 2 to 4.

These shrink threads 4 are preferably spun of yarn which consists, partly or as a whole, of one or several synthetic fibres, of continuous filament yarn, consisting of one or several synthetic filaments, of monofilament consisting of one or several synthetic base materials, or of elastic yarns or filaments.

As an example, the cloth 1 can be woven of polyethylene weft threads 2, which under influence of a thermal treatment will shrink in length with about 5 to 7%. In that case, shrink threads 4 may be used that are woven in a general direction parallel to said weft threads 2, which shrink threads 4 are spun of another polyethylene material, that will shrink in length for about 30 to 35% under the influence of said thermal treatment.

In order to form a permanent fold 6, the cloth 1 is subjected to the above-mentioned treatment for making the shrink threads 4 shrink, at least in the required folding zone 5.

Figure 3:
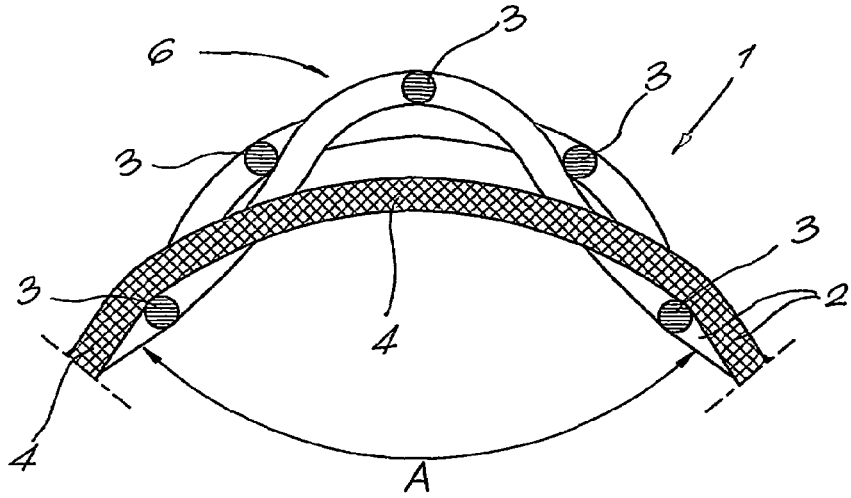
FIG. 3 represents the part from FIG. 2 after a permanent fold has been formed according to the method of the invention.

It is clear that, as a result of this shrinkage of the shrink threads 4, the warp threads 3 abutting the folding zone 5 on either side of said folding zone 5 are drawn towards each other, so that the weft threads 2 are folded, as represented in FIG. 3.

The shrinkage is irreversible, which implies that a permanent fold 6 is obtained.

It is clear that the folding of the weft threads 2 towards one or other side of the cloth 1 is determined by the side along which the shrink threads 4 extend over the folding zone 5.

Figure 4:
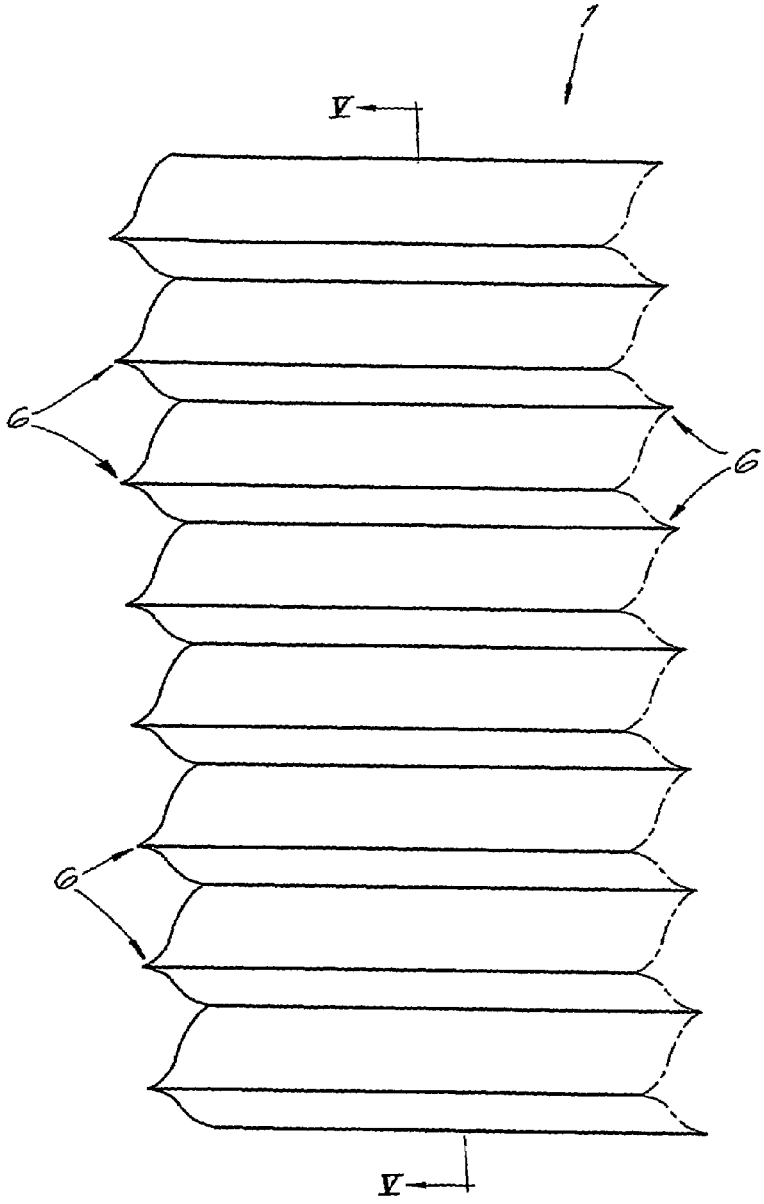
FIG. 4 schematically represents a view in perspective of a cloth with folds made according to the method of the invention.
Figure 5:
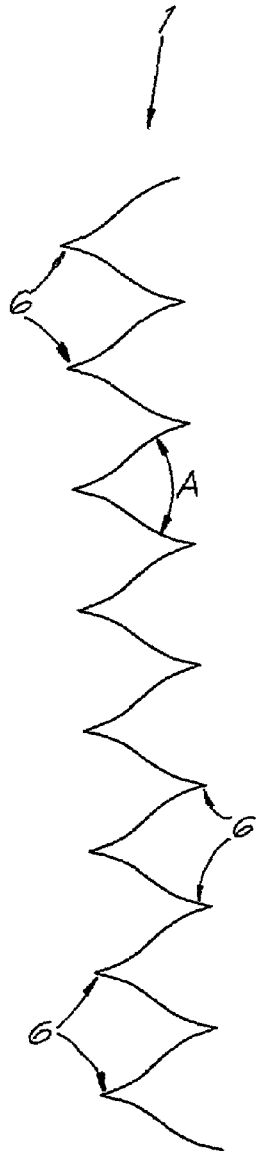
FIG. 5 represents a section according to line V-V in FIG. 4.

FIGS. 4 and 5 represent a cloth 1 which is obtained according to the above-mentioned method of the invention starting from a cloth 1, whereby the shrink threads 4 alternately extend on either side of the successive folding zones 5.

This implies that the shrink threads 4 in the cloth 1, which are at the basis of the successive folds 6, successively extend unbound over the folding zone 5, on either side of the cloth 1, and thus of the warp threads 3.

The size of the shrinkage and the distance B, or in other words the number of overlapped warp threads 3 over which the shrink threads 4 extend unbound on a single side of the warp threads 3, determine the opening of the folds 6 or, in other words, they determine how strongly the warp threads 3 are drawn towards each other on either side of the folding zone 5, and thus how large the angle A between these neighbouring parts will be, provided they are free to diverge.

Naturally, the folds 6 can be pushed together, so that the parts of the cloth 1 situated between the successive folding zones 5 are brought together, whereby the above-mentioned angle A is practically reduced to zero.

Figure 6:
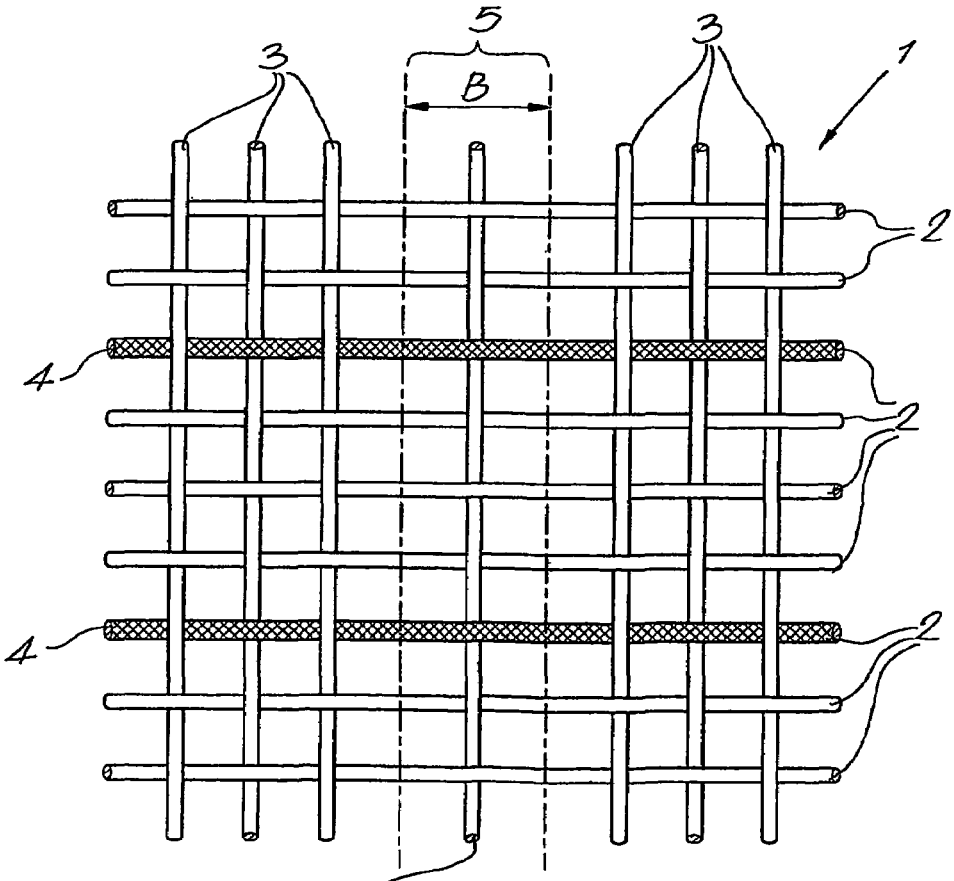
FIG. 6 represents a variant of FIG. 3.

FIG. 6 represents a variant of a part of a cloth 1 according to the invention, whereby the warp threads 3 are woven farther away from each other in the folding zone 5, as a result of which the shrink threads 4 in this folding zone 5 will be automatically situated over a larger distance B on a single side of the cloth 1 than anywhere else in the cloth 1, outside the folding zone, folding zones 5 respectively.

A cloth 1 with permanent folds 6 is also in this case obtained in the above-described manner by applying the treatment which makes the shrink threads 4 shrink.

In all the above-mentioned embodiments, a cloth 1 with dimensionally stable folds 6 is obtained which are in this case formed in the direction of the warp, whereby these folds 6 can be opened in a flexible manner.

The cloth 1 can be any fabric whatsoever, such as a gauze or the like, with any weave whatsoever between the weft threads 2 and the warp threads 3.

The cloth 1 must not even necessarily be a fabric. It can also be a knitting or even a non-woven. In the latter case, the shrink threads 4 must be provided after the non-woven has been manufactured.

The cloth 1 provided with folds 6 can be an insect screen, a sun screen, a curtain, packaging material, a carrier bag, an attaché-case or a part thereof, the lining of a suitcase, a filtering cloth or, as a matter of fact, any object made of fabric material provided with one or several permanent folds 6.

It is clear that, in the different embodiments according to the invention, the shrink threads 4 can be woven in the direction of the warp, whereby the folding zones 5 extend in the direction of the weft if necessary.

The invention is by no means limited to the above-described embodiment represented in the accompanying drawings; on the contrary, such a cloth and such a method for manufacturing a cloth with at least one permanent fold can be made in all sorts of variants while still remaining within the scope of the invention.

The invention claimed is:

1. Cloth designed to be provided with at least one permanent fold, comprising:

a plurality of weft threads oriented in a weft direction;

a plurality of warp threads interwoven in a uniformly spaced manner with the weft threads in a warp direction;

at least one folding zone arranged to define the at least one permanent fold extending in the warp direction; and at least one shrink thread woven in said cloth, wherein the at least one shrink thread is woven in the cloth in the weft direction and extending crosswise over the folding zone, wherein the spacing of the plurality of warp threads within the folding zone is increased such that the at least one shrink thread is situated over a larger distance on a single side of the cloth than anywhere else in the cloth outside the folding zone.

2. Cloth according to claim 1, wherein said at least one shrink thread comprises several shrink threads extending at a distance from each other over the folding zone.

3. Cloth according to claim 1, wherein said at least one shrink thread is made of a material that shrinks, on application of an appropriate treatment, with at least 5% more than the material of which are made the remaining threads that are woven in a general direction parallel to said at least one shrink thread.

4. Method for realizing at least one permanent fold in a cloth according to claim 1, comprising subjecting the cloth, at least there where a fold is to be formed, to a treatment to make the at least one shrink thread shrink at least in said folding zone.

5. Method according to claim 4, wherein the entire cloth is subjected to the treatment to make the at least one shrink thread shrink.

* * * * *